United States Patent [19]

Vaughan

[11] 4,346,767

[45] Aug. 31, 1982

[54] ROTARY IMPACT DRILL

[75] Inventor: Christopher A. Vaughan, Morden, England

[73] Assignee: Kango Electric Hammers Limited, London, England

[21] Appl. No.: 158,383

[22] Filed: Jun. 11, 1980

[51] Int. Cl.[3] ..... E21C 1/12; B25D 16/00

[52] U.S. Cl. ..... 173/109; 173/118

[58] Field of Search ..... 173/118, 109, 117; 74/22 R

[56] References Cited

U.S. PATENT DOCUMENTS

| | | | |
|---|---|---|---|
| 3,521,497 | 7/1970 | Schmuck | 173/108 X |
| 3,741,317 | 6/1973 | Unterschweiger | 173/109 |
| 3,774,699 | 11/1973 | Schmuck | 173/109 X |
| 4,114,699 | 9/1978 | Wolf | 173/118 X |

*Primary Examiner*—Werner H. Schroeder
*Assistant Examiner*—Andrew M. Falik
*Attorney, Agent, or Firm*—Wenderoth, Lind & Ponack

[57] ABSTRACT

A portable electric hammer drill incorporates an electric motor 12 disposed close to the handle 13 of the tool and with its axis of rotation at right angles to the axis of rotation of the drill bit holder 10, and a gear 15 on the motor shaft meshes with a first pinion 16 driving the holder in rotation. A second pinion 25 meshes with the first pinion 16 and drives the driving piston 30 of the mechanism for transmitting impacts to the holder. The axes of rotation of the holder 10, the first and second pinions and the gear 15 ;are coplanar, and the first and second pinions are on diametrically opposite sides of the said gear, the first pinion being nearer the handle. This arrangement enables the motor to be placed nearer the handle than if the first pinion were in direct mesh with the said gear, and thus improves the balance of the tool. The arrangement permits the diameters of the first and second pinions to be selected independently of each other.

1 Claim, 1 Drawing Figure

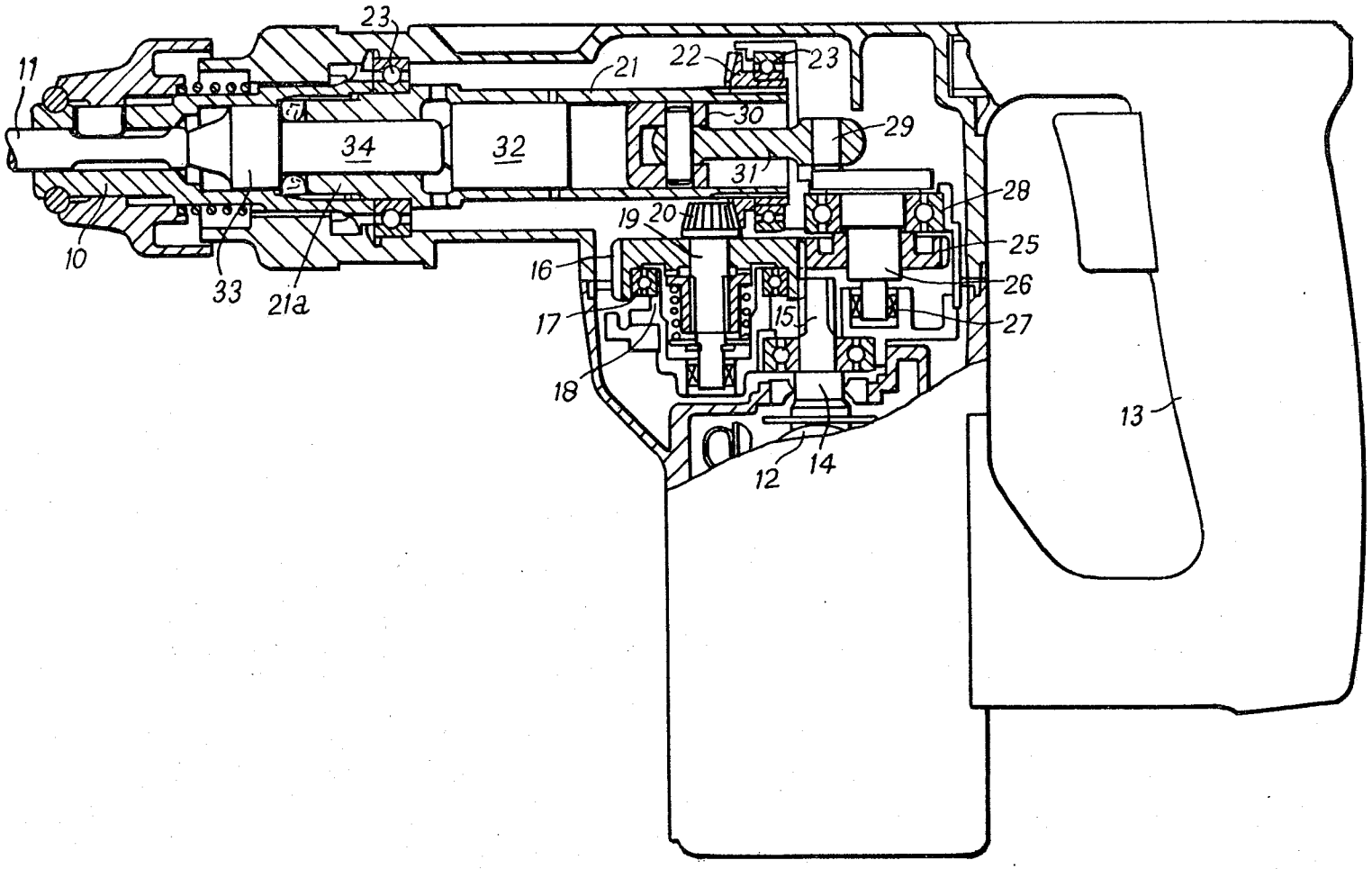
13
28
25
26
27
29
23
14
15
12
30
31
22
20
21
19
16
17
18
32
23
34
21a
33
10
11

ROTARY IMPACT DRILL

This invention relates to electric hammer drills.

BACKGROUND OF THE INVENTION AND PRIOR ART

Electric hammer drills are required to provide a rotary drive for rotating the drill and a reciprocatory drive which is converted into a hammering action on the drill. The reciprocatory drive is obtained from a rotary crank-shaft and piston mechanism or other rotary shaft-driven mechanism. In the well-known type of electric hammer drill in which the motor is disposed with its output shaft at right angles to the drill axis, the motor is located adjacent the handle so as to achieve the best balance of the tool for the operator. In the most common constructions of this kind, of which U.S. Pat. No. 3,161,242 shows an example, an output pinion on the motor shaft meshes with a first gear on a parallel shaft which drives the reciprocatory mechanism and which has fixed to it a second gear forming part of a reduction gear for rotating the drill. The chief disadvantage of this arrangement is that any change in the reduction ratio of the drive from the motor shaft to the said parallel shaft to alter the hammering frequency also produces a change in the relationship between the motor speed and the drill speed. In a mechanism shown in U.S. Pat. No. 3,521,497, the two gears which respectively drive the reciprocating mechanism and rotate the drill engage the motor pinion at diametrically opposite sides thereof, so that the aforesaid disadvantage is overcome and the advantage of a lower tooth loading on the motor pinion is obtained. However, the general layout of the hammer drill dictates that the two said gears are respectively disposed at the handle side and drill side of the tool, and the motor must be positioned sufficiently far forward of the handle to allow for this, so that the resulting tool is less well balanced.

BRIEF SUMMARY OF THE INVENTION

The present invention is concerned with providing an electric hammer drill in which the reduction ratios between the motor pinion and the two main driving gears producing hammering and rotation of the drill can each be set independently of the other and in which the motor can be disposed close to the handle. The latter advantage may permit a reduction in the length of the hammer drill and a consequent reduction in weight.

According to this invention there is provided an electric hammer drill comprising a casing having a handle at its rearward end and carrying at its forward end a forwardly projecting drill bit holder, an electric motor mounted just forward of the handle and disposed with its axis of rotation at right angles to the axis of rotation of the holder, said casing housing means for rotating the holder, means for delivering impacts to the holder, an output gear on the motor shaft, a first pinion meshing with the output gear and connected to drive said means for the holder, a second pinion meshing with the first pinion and connected to drive said means for delivering said impacts to the holder, the respective axes of rotation of the first and second pinions being at diametrically opposite sides of the axis of the motor shaft, the four said axes being contained in a common plane, and the said axis of the second pinion being further than the said axes of the first pinion and the motor shaft from the holder.

BRIEF DESCRIPTION OF THE DRAWING

One embodiment of the invention will now be described with reference to the accompanying drawing showing an electric hammer in axial section.

DETAILED DESCRIPTION OF THE INVENTION

Referring to the drawing, there is shown a portable electric hammer drill equipped with a holder 10 for a drilling bit 11. The drill holder 10 is arranged to receive simultaneously a rotary drive and hammer blows. Both of these actions are transmitted to the drill holder from an electric motor 12 through respective mechanisms.

Motor 12 is mounted close to a handle 13 secured to the rear end of a drill casing and has its output shaft 14 extending at right angles to the axis of rotation of the holder. The output shaft is formed with gear teeth 15 which mesh with an annular first pinion 16 rotatably mounted on a bearing 17 carried on a collar 18 secured to the casing of the drill. A spindle 19 carrying a bevel gear 20 at one end extends coaxially through the pinion 16, and the pinion drives spindle 20 through an overload clutch mechanism. The bevel gear 20 meshes with the teeth of a bevel ring gear 22 splined on one end of a cylinder 21 of the striker mechanism. Cylinder 21 is rotatably supported in bearings 23 carried in the casing and its forward end portion **21*a* has the tool holder 10 screwed on to it, so that the motor drives the tool in rotation through gear teeth 15, pinion 16, the overload clutch, bevel gear 20 and cylinder 21**.

The gear teeth of the first pinion 16 extend axially beyond the end of the motor shaft 14, permitting a second pinion 25 to mesh with pinion 16. Pinion 25 is secured on a short shaft 26 rotatably mounted in bearings 27, 28 in the casing, and the rotational axes of pinions 16 and 25 and of the motor shaft 14 are coplanar with each other and with the axis of rotation of the cylinder 21.

The shaft of pinion 25 carries a crank-pin 29 at its end remote from motor 12, and a driver piston 30 mounted for reciprocation in the rotary cylinder 21 is coupled to the crank-pin by a connecting rod 31. A striker piston 32 is slidably mounted in the forward end portion of the cylinder 21, and in the well known manner, air trapped between the driver and striker pistons 30, 32 causes the striker piston to follow the reciprocatory movement of the driver piston but slightly out of phase therewith. An anvil 33 axially slidably mounted in a bore in the holder has a reduced-diameter portion 34 projecting into the forward end **21*a* of the cylinder 21, and portion 34 is struck by the striker piston 32 during the forward movement of the latter and transmits the impacts to the adjacent end of the shank of the drilling bit 11**.

It will be apparent that meshing of pinion 25 with pinion 16 and the relative disposition of the two pinions enables the motor to be mounted nearer to the handle by a distance substantially equal to the pitch circle diameter of the motor shaft teeth 15 than if pinion 25 meshed with teeth 15 directly at a location diametrically opposite pinion 16. Owing to the weight of the motor, it is advantageous to bring its center of gravity as near to the hand grip as possible so as to improve the balance and handling of the drill. At the same time, the numbers of teeth on pinions 16 and 25 can be independently selected since neither number affects the other.

I claim:

1. An electric hammer drill comprising a casing having a handle at its rearward end and carrying at its forward end a forwardly projecting drill bit holder, an electric motor mounted just forward of the handle and disposed with its axis of rotation at right angles to the axis of rotation of the holder, said casing housing means for rotating the holder, means for delivering impacts to the holder, an output gear on the motor shaft, a first pinion meshing with the output gear and connected to drive said means for the holder, a second pinion meshing with the first pinion and connected to drive said means for delivering said impacts to the holder, the respective axes of rotation of the first and second pinions being at diametrically opposite sides of the axis of the motor shaft, the four said axes being contained in a common plane, and the said axis of the second pinion being further than the said axes of the first pinion and the motor shaft from the holder.

* * * * *